United States Patent [19]

Crabbi

[11] Patent Number: 4,974,993

[45] Date of Patent: Dec. 4, 1990

[54] METHOD OF RENEWING A ROAD SURFACE OF BITUMINOUS MIX, WITH COLD APPLICATION OF THE RECYCLED COVERING MATERIAL

[75] Inventor: Bruno Crabbi, Vigevano, Italy

[73] Assignee: Wirtgen Macchine S.r.l., Italy

[21] Appl. No.: 297,484

[22] Filed: Jan. 17, 1989

[30] Foreign Application Priority Data

Jan. 15, 1988 [IT] Italy ..... 19093 A/88

[51] Int. Cl.[5] ..... E01C 23/14

[52] U.S. Cl. ..... 404/79; 404/75

[58] Field of Search ..... 404/91, 92, 75, 79, 404/82, 101, 90; 299/39

[56] References Cited

U.S. PATENT DOCUMENTS

| | | | |
|---|---|---|---|
| 3,930,094 | 12/1975 | Sampson et al. | 264/DIG. 81 |
| 3,965,064 | 6/1976 | Mercier et al. | 524/172 |
| 4,011,023 | 3/1977 | Cutler | 404/91 |
| 4,112,152 | 9/1978 | Dolk et al. | 427/385.5 |
| 4,134,535 | 1/1979 | Barthels et al. | 426/118 |
| 4,373,961 | 2/1983 | Stone | 404/72 |
| 4,374,675 | 2/1983 | Scotti et al. | 427/218 |
| 4,629,511 | 12/1986 | Vanderzanden | 106/277 |
| 4,637,753 | 1/1987 | Swisher, Jr. | 299/39 |
| 4,846,602 | 7/1989 | Sainton | 404/75 |

FOREIGN PATENT DOCUMENTS

| | | | |
|---|---|---|---|
| 2485057 | 12/1981 | France | 404/91 |
| 454726 | 6/1968 | Switzerland . | |

OTHER PUBLICATIONS

International Construction, vol. 23, No. 11, Nov. 1984, p. 88, Haywards Health, GB; "CMI Cold Recycler Has High Production".

*Primary Examiner*—Bruce M. Kisliuk
*Assistant Examiner*—Gay Ann Spahn
*Attorney, Agent, or Firm*—Arnold, White & Durkee

[57] ABSTRACT

A method for renewing a road surface based on bituminous mix and granular mix, comprising removing the road surface to be replaced, by scarifying; collecting the removed material and conveying it to devices for screening and crushing to predetermined particle size, and then to a mixer where aqueous bitumen emulsion is added, the mixture obtained being recycled directly to form the new road surface by depositing and levelling the mixture after spraying bitumen emulsion, and finally rolling the road surface thus formed. A self-propelled machine for implementing said operations is also provided.

3 Claims, 2 Drawing Sheets

METHOD OF RENEWING A ROAD SURFACE OF BITUMINOUS MIX, WITH COLD APPLICATION OF THE RECYCLED COVERING MATERIAL

BACKGROUND OF THE INVENTION

The method of the invention consists of a sequence of operations for renewing the surface layer of a conventional road surface, conventional in the sense of a layered surface of thickness varying between 3 cm and 8 cm, deposited either on an underlying support layer of thickness varying between 15 cm and 30 cm or directly on a foundation in the form of non-bituminous mix or stabilized granular mix.

The method is based on immediately and directly recycling the material removed by scarification, after cold-mixing it with an aqueous bitumen emulsion, it thereby differing from known methods which require hot-mixing of the solid material with molten bitumen.

The conventional methods for renewing damaged road surfaces comprise the following operations using the stated equipment:

(a) preparing the bituminous mix by hot-mixing bitumen, sand and various inerts together in a suitable fixed plant and loading the mix into containers suitable for transportation;

(b) transferring the bituminous mix from the fixed plant of operation (a) to the laying site by trucks;

(c) loading the material brought on site into a vibro-finishing machine which applies the mix to the road bed after spraying it with bituminous emulsion to facilitate adhesion of the mix to the road bed;

(d) spreading the bituminous mix by a levelling screw and then rolling it to the thickness of the layer to be deposited.

In the conventional methods of the aforesaid type, not more than 50% of the material removed from the road surface can be reused.

In a known improved method described in Italian patent application No. 3520 A/82 in the name of the inventor of the present application, the method is implemented using a single self-propelled operating unit which removes the surface layer to be replaced, and mixes the removed material with molten bitumen at a temperature on the order of 140° C. to obtain a bituminous mix which is applied directly for forming the new road surface.

This system has the great advantage of dispensing with the need for transporting the scarified material (rubble) of the removed road surface to the fixed plant for its mixing with fresh bitumen and the subsequent transporting of the bituminous mix to the site on which it is to be used.

SUMMARY OF THE INVENTION

The method of the present invention represents considerable technological progress in that the material to be recycled is cold-mixed with bitumen in the form of an aqueous emulsion. This therefore avoids the need to heat the mass of recycled material and the bitumen to high temperature (on the order of 140° C.). This thus results in a considerable cost reduction in terms of fuel saving and simplified plant facilities. In this respect, this latter no longer comprises the devices for heating the material mass (recycled or newly fed) and the bitumen, which necessarily result in a bulky plant of large overall dimensions which is difficult to use in urban centers along narrow or winding streets. Known plants for in-situ hot renewal are in fact substantially designed for motorways and roads of high-density traffic, i.e., of considerable width.

The method according to the present invention enables the bituminous mix to be formed using all of the recycled material also without the addition of fresh feed material. This means that the new road surface will have the same thickness as that removed, thus avoiding raising of the road level. The raising of the road level which inevitably occurs when the amount of new mix applied is greater than the quantity of material removed results in a series of drawbacks, including: an altered lateral drain water outflow situation and altered road drain well levels in urban streets, an altered pavement height above the road surface, and altered driveway connections.

DETAILED DESCRIPTION OF THE PREFERRED EMBODIMENTS

The method of the present invention comprises the following basic operations:

1. removing the road surface to be replaced, by scarifying;
2. transferring the removed material, of varying particle size, and wetting it by spraying water to obtain a water content of 30–40% by weight;
3. screening the material to separate the material of particle size exceeding 35 mm, which is fed to a mill for crushing a controlled particle size;
4. adding to the solid material dioctylphthalate (DOP) or another substance having an equivalent surface-active and solubilizing, dispersing effect towards the bituminous material, in a quantity of up to about 1% by weight, and also adding aqueous bitumen emulsion having a concentration of between 30% and 70% and preferably about 60% by weight and a viscosity of between 3 and 5 degrees Engler, the quantity of bituminous emulsion used varying according to the type of recycle material used and any addition of fresh solid material, but generally being between 1% and 3% by weight;
5. homogenizing the obtained mixture under cold conditions;
6. depositing the mixture after spraying the road bed with bitumen emulsion, then levelling the deposited material;
7. rolling by conventional methods.

The road surface is removed by an independent self-propelled scarifying machine. Operations 2 to 6 can be performed using a single suitably equipped self-propelled machine which forms one aspect of the present invention and is described hereinafter. Rolling operation 7 is performed by conventional equipment.

This working system obviously results in production and thus advancement rates which are not particularly high compared with known methods and equipment for motorway work, but it has the advantage of not depending on the availability and productivity of upstream auxiliary services in the form of fixed plant.

Merits and advantages of the system according to the present invention are:

elimination of auxiliary fixed plant for supplying the bituminous mix;

elimination of the need to transport said material from the fixed plant to the site of application, this requiring trucks and drivers; and reduction in the cost of the bitumen to be used in the renewal procedure by employing an aqueous bitumen emulsion.

In addition, the system is based on the total recycling of the removed material with only a small addition of bitumen, without the need to add further fresh feed material; consequently the thickness of the renewed road surface corresponds substantially to that of the removed surface, with the result that the road height and the relative positions of pavements, drain wells, water drains and the like are unchanged.

In the method of the invention the material for forming the new road surface is prepared as stated heretofore by cold-mixing the crushed removed material with a small quantity of aqueous bitumen emulsion.

Figure 2:
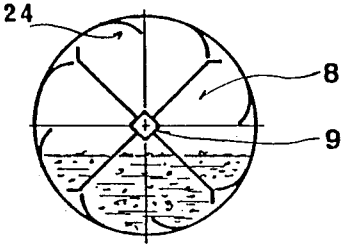
FIG. 2 is a cross-sectional view of the rotary mixer shown in FIG. 1.
Figure 3:
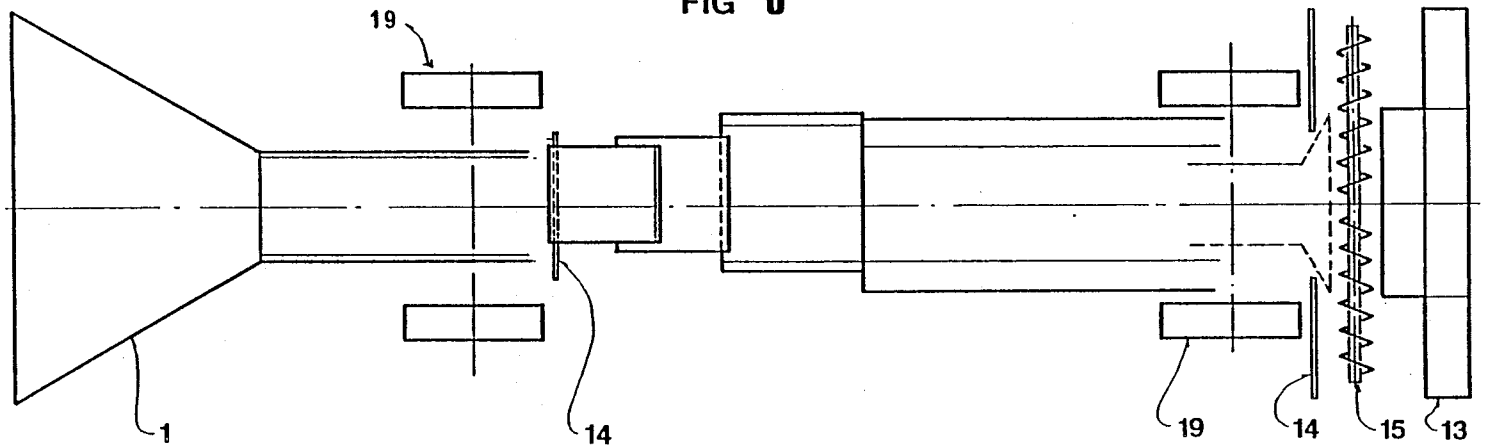
FIG. 3 is a top elevational view of the self-propelled machine shown in FIG. 1.

A further aspect of the present invention is a self-propelled machine equipped for simultaneously implementing the aforesaid operations 2 to 6 in a coordinated manner. The machine, described hereinafter with reference to FIGS. 1, 2 and 3 for more immediate understanding, comprises the following operating parts and devices:

a collector 1 for the scarified material of varying particle size;

an endless conveyor 2, such as a feed belt, which conveys said material to a screen 6 after the material has been continuously and automatically weighed by the weighing device 3;

a roller crusher 7 for crushing to a controlled particle size that material having a particle size exceeding 35 mm and therefore not passing through the screen 6;

a water spraying device 20 with its water tank 4 and moisture control probe 21 connected to a controller 12 for example of Ramsey type, for controlling the quantity of water sprayed;

an aqueous bitumen emulsion sprayer 14*a* and a DOP (or equivalent liquid) sprayer 22 for the screened and crushed material;

a tank 5 for the DOP or equivalent liquid;

a bituminous emulsion tank 10 provided with stirrers 18;

bituminous emulsion sprayers 14 and 14*b* for its application respectively to the central part and to the two lateral parts of the road bed;

an engine 11 and relative fuel tank 16 for operating and advancing the machine, for example a 360 HP diesel engine;

a cover 17 for inspecting the screen 6;

a rotary mixer 8 for homogenizing the screened and crushed solid material after addition of DOP and bitumen emulsion, and provided with a rotary shaft 9 comprising mixing arms, and with curved conveying plates 24;

a double-screw dividing feeder 15 for distributing the mixed material;

a material leveller (scraper) 13, for example of the vibration-hammering finishing beam type;

support and drive wheels 19;

hydraulic pistons 23 for adjusting the position (height) of the mixer 8.

Figure 1:
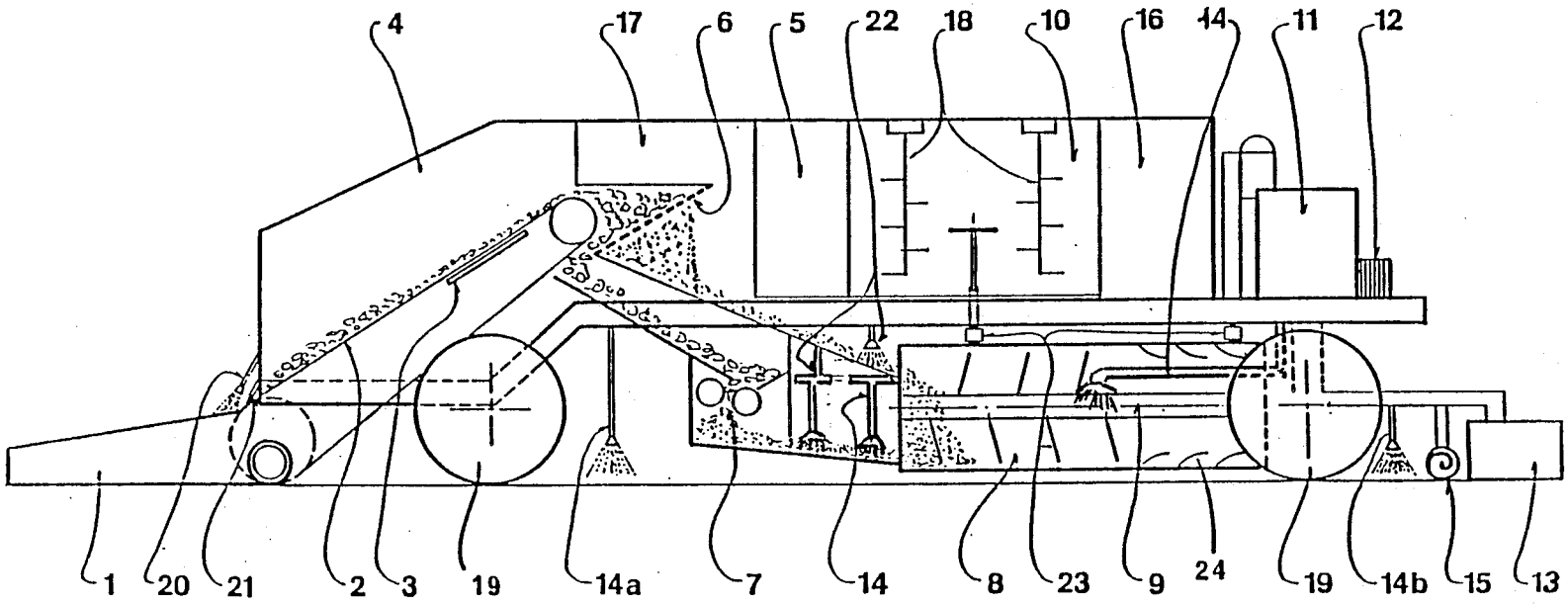
FIG. 1 is a cross-sectional side view of the self-propelled machine used in the method of the present invention.

The machine operation is automatic, particularly with the delivery by the water, DOP and bitumen emulsion sprayers being controlled by the electronic control device such as of Ramsey type, indicated by the reference numeral 12 in FIG. 1.

I claim:

1. A self-propelled machine of self-contained operation for renewing, with the aid of an independent scarifying machine, a bituminous mix road surface, comprising:

collection means for collecting scarified road surface material;

conveying means for transporting collected material to a screen after the material has been continuously and automatically weighed by a weighing device;

crushing means for crushing material having a particle size of greater than 35 mm;

water supply means for adding a quantity of water to the crushed material, said water supply means comprising a water tank and moisture control probe connected to a controller for regulating said quantity of water;

first spray means for applying an aqueous bitumen emulsion and liquid homogenizing additives to the crushed material;

second spray means for applying said aqueous bitumen emulsion to central and lateral portions, respectively, of a road surface to be renewed;

a rotary mixer for homogenizing the screened and crushed material after addition of the bitumen emulsion and homogenizing additives, said mixer comprising a rotary shaft, mixing arms, and curved conveying plates;

a double-screw dividing feeder for distributing the mixed material onto the road surface to be renewed;

levelling means for levelling said material supplied to said road surface; and means for adjusting the height of said mixer.

2. A method for renewing a bituminous mix road surface, comprings the steps of:

removing, by scarifying, the road surface to be replaced, thus leaving a road bed;

collecting the removed road surface material and conveying it to screening and crushing devices to reduce pieces of the material of excessive size;

adding 30%–40% by weight water to the screened and crushed material by spraying;

adding less than about 1% by weight dioctylphthalate and about 1%–3% by weight aqueous bitumen emulsion having a concentration of between 30% and 70% by weight and a viscosity of between 3 and 5 degrees Engler to the wetted material;

homogenizing the mixture of road surface material and additives by mixing under cold conditions;

depositing the obtained mixture in a uniform layer on the road bed; and levelling and rolling the uniform layer to form a road surface.

3. The method of claim 2, wherein the aqueous bitumen emulsion contains about 60% by weight bitumen.

* * * * *